US010149598B2

(12) United States Patent
Doane

(10) Patent No.: US 10,149,598 B2
(45) Date of Patent: Dec. 11, 2018

(54) DEBRIS COLLECTION DEVICE

(71) Applicant: Fred Doane, Lake Geneva, WI (US)

(72) Inventor: Fred Doane, Lake Geneva, WI (US)

( * ) Notice: Subject to any disclaimer, the term of this patent is extended or adjusted under 35 U.S.C. 154(b) by 191 days.

(21) Appl. No.: 15/277,005

(22) Filed: Sep. 27, 2016

(65) Prior Publication Data

US 2018/0084969 A1 Mar. 29, 2018

(51) Int. Cl.
*A47L 25/00* (2006.01)

(52) U.S. Cl.
CPC ..... *A47L 25/005* (2013.01)

(58) Field of Classification Search
CPC ..... A47L 25/005; B08B 7/0028
USPC ..... 15/104.002
See application file for complete search history.

(56) References Cited

U.S. PATENT DOCUMENTS 2,755,494 A 7/1956 Bredin
4,490,870 A * 1/1985 Taub ..... A47L 13/40 134/1
4,575,890 A 3/1986 Hidle
D443,986 S 6/2001 Marino
6,298,517 B1 * 10/2001 McKay ..... A47L 13/20 15/144.1
6,343,397 B1 2/2002 Ogdagiri
6,735,806 B2 5/2004 Blum et al.
7,234,188 B1 * 6/2007 McKay ..... A47L 25/005 15/104.002
8,015,651 B2 9/2011 Knopow et al.
8,458,848 B1 6/2013 Dondurur et al.
2002/0088070 A1 * 7/2002 Cho ..... A47L 25/005 15/104.002
2004/0134003 A1 * 7/2004 McKay, Jr. ..... A47L 13/20 15/104.002
2006/0254017 A1 * 11/2006 Knopow ..... A47L 25/005 15/250.22
2007/0163062 A1 * 7/2007 McKay ..... A47L 25/005 15/104.002
2009/0176021 A1 * 7/2009 Walsh ..... B08B 1/04 427/299
2011/0247651 A1 * 10/2011 Neumann ..... A47L 11/33 134/6
2015/0107038 A1 * 4/2015 Lee ..... A47L 25/005 15/104.002
2016/0000298 A1 * 1/2016 Trunsky ..... A47L 25/005 15/104.002
2016/0213223 A1 * 7/2016 Williamson ..... A47L 25/005
2017/0001212 A1 * 1/2017 Birkner ..... B05B 15/52

FOREIGN PATENT DOCUMENTS

WO WO2007030148 3/2007

* cited by examiner

*Primary Examiner* — Weilun Lo

(57) ABSTRACT

A debris collection device for sanitary collection of debris onto an adhesive strip includes a housing that defines an internal space. A pair of rollers is rotationally coupled to and extends perpendicularly from a side of the housing. The rollers are positioned singly proximate to a first end and a second end of the housing. A drive is coupled to the housing and is positioned in the internal space. The drive is operationally coupled to the rollers such that the rollers rotate coincidentally. Each opposing end of a strip is couplable to a respective roller. An adhesive is coupled to a face of the strip. A handle is coupled to and extends from the second end of the housing. A respective roller is configured to position and roll upon a surface to adhesively collect debris onto the strip.

14 Claims, 4 Drawing Sheets

DEBRIS COLLECTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to debris collection devices and more particularly pertains to a new debris collection device for sanitary collection of debris onto an adhesive strip.

BRIEF SUMMARY OF THE INVENTION

An embodiment of the disclosure meets the needs presented above by generally comprising a housing that defines an internal space. A pair of rollers is rotationally coupled to and extends perpendicularly from a side of the housing. The rollers are positioned singly proximate to a first end and a second end of the housing. A drive is coupled to the housing and is positioned in the internal space. The drive is operationally coupled to the rollers such that the rollers rotate coincidentally. Each opposing end of a strip is couplable to a respective roller. An adhesive is coupled to a face of the strip. A handle is coupled to and extends from the second end of the housing. A respective roller is configured to position and roll upon a surface to adhesively collect debris onto the strip.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
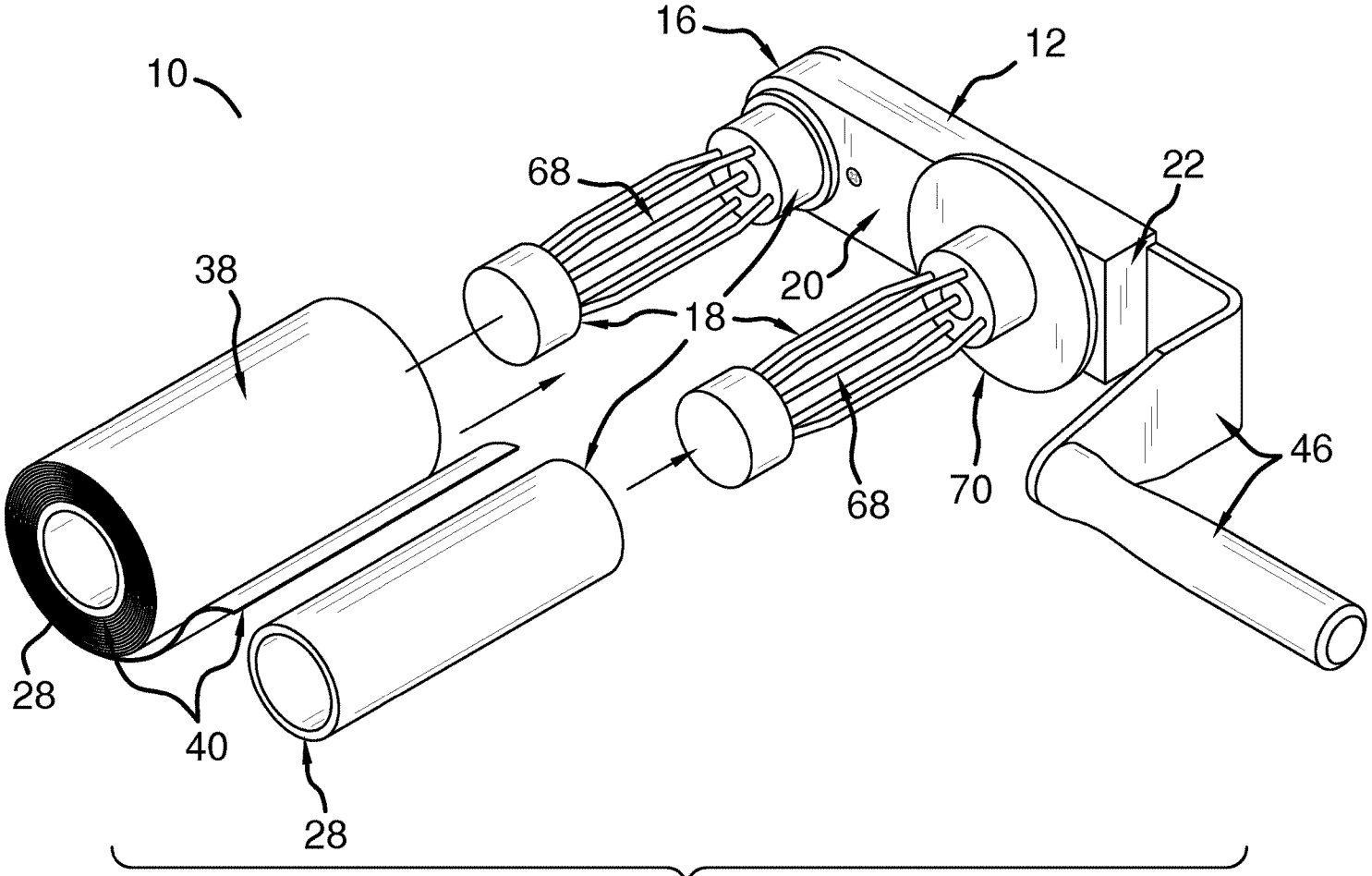
FIG. 1 is an isometric perspective view of a debris collection device according to an embodiment of the disclosure.
Figure 2:
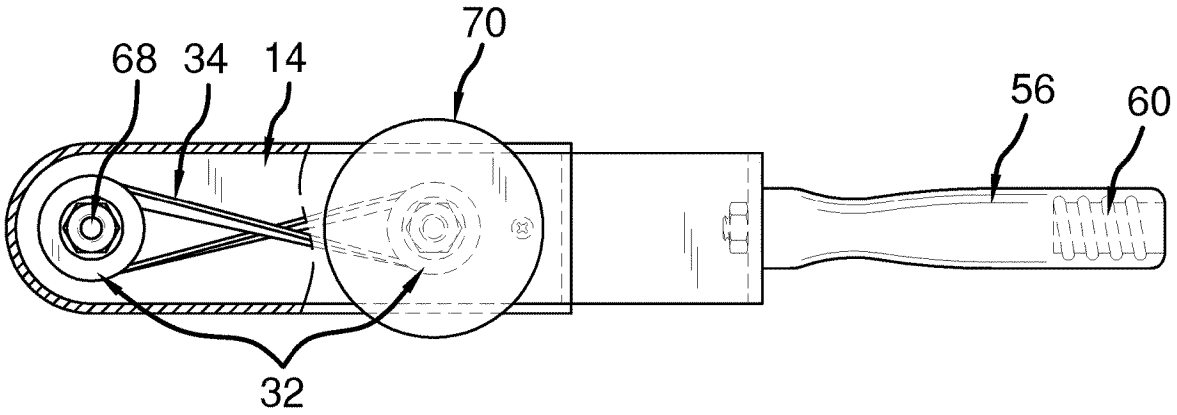
FIG. 2 is a cross-sectional view of an embodiment of the disclosure.
Figure 3:
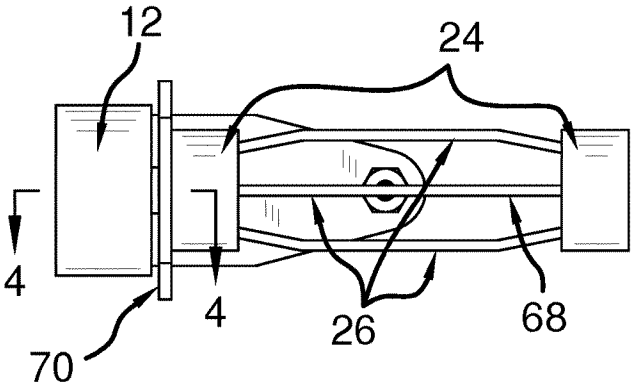
FIG. 3 is an end view of an embodiment of the disclosure.
Figure 4:
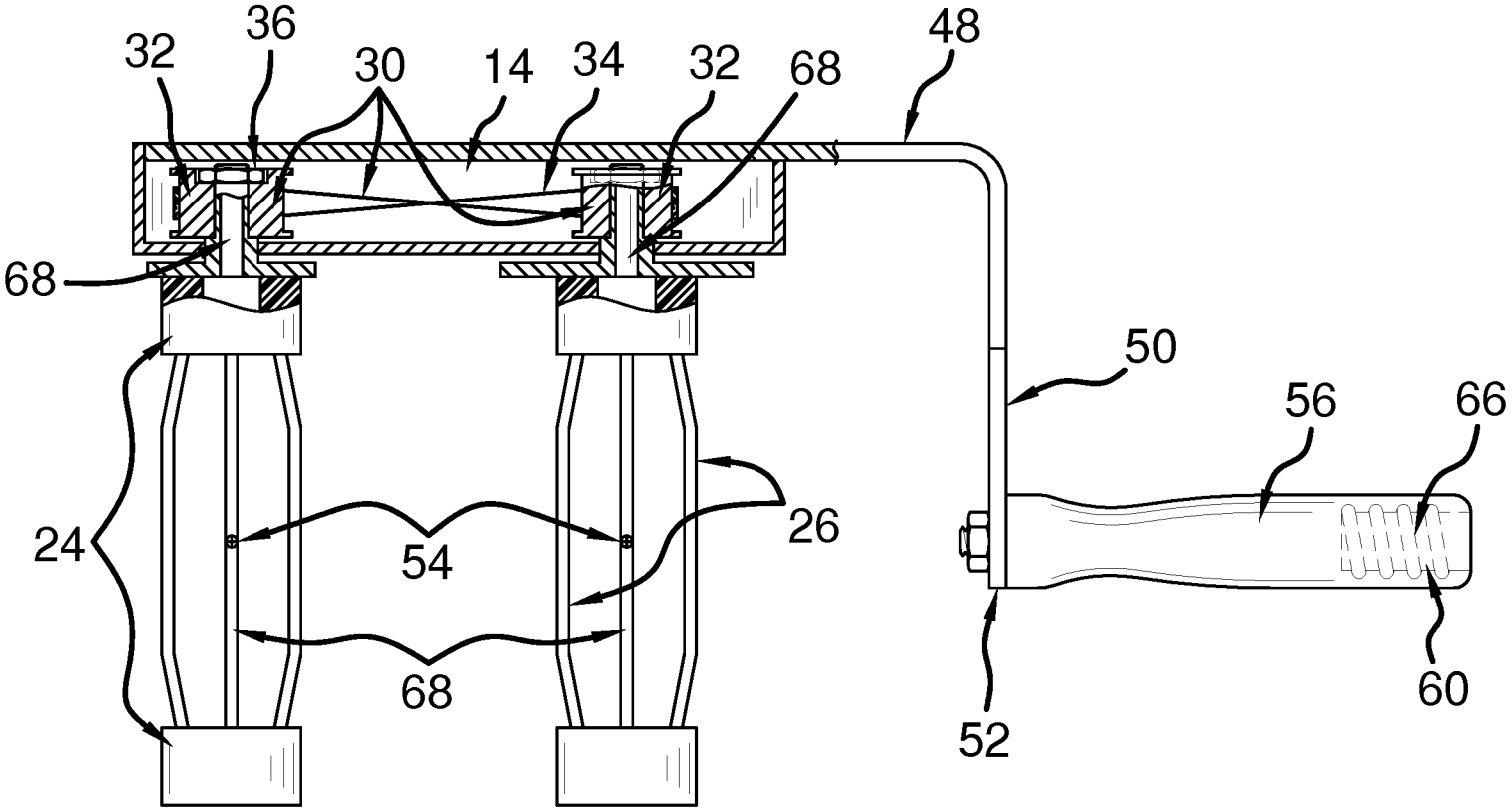
FIG. 4 is a cross-sectional view of an embodiment of the disclosure.
Figure 5:
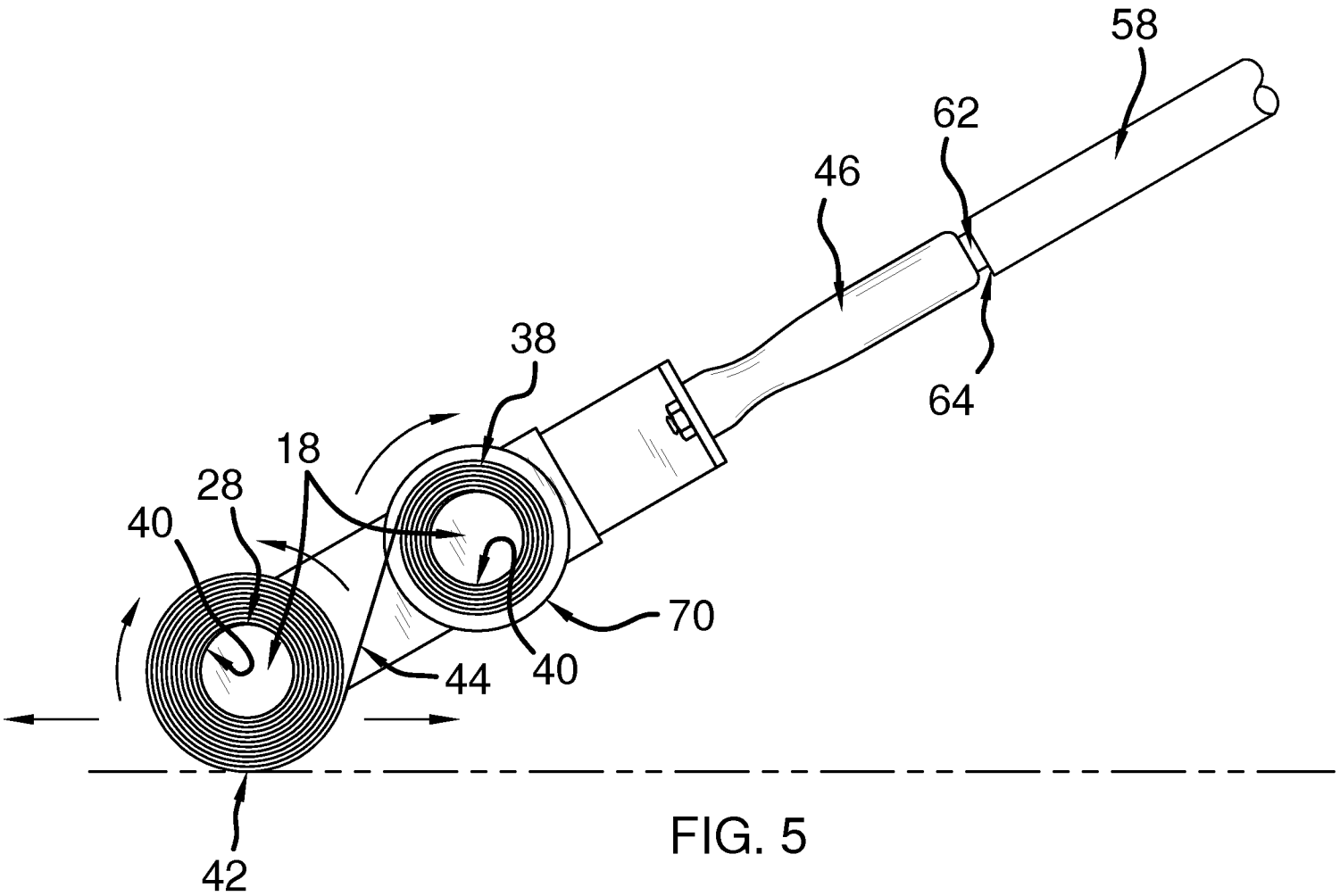
FIG. 5 is an in-use view of an embodiment of the disclosure.

With reference now to the drawings, and in particular to FIGS. 1 through 5 thereof, a new debris collection device embodying the principles and concepts of an embodiment of the disclosure and generally designated by the reference numeral 10 will be described.

As best illustrated in FIGS. 1 through 5, the debris collection device 10 generally comprises a housing 12 that defines an internal space 14. In one embodiment, the housing 12 is substantially rectangularly box shaped. The housing 12 has a first end 16. In another embodiment, the first end 16 is rounded.

Each of a pair of rollers 18 is rotationally coupled to and extends perpendicularly from a side 20 of the housing 12. The rollers 18 are positioned singly proximate to the first end 16 and a second end 22 of the housing 12. In one embodiment, each roller 18 comprises a pair of endcaps 24, a plurality of connectors 26 and a tube 28. The connectors 26 are coupled to and extend between the endcaps 24. The tube 28 is reversibly positionable over the endcaps 24 and the connectors 26. The tube 28 is frictionally couplable to the connectors 26.

In another embodiment, each roller 18 comprises an axle 68. The axle 68 is coupled to and extends between the pair of endcaps 24. The axle 68 extends through a respective endcap 24 into the housing 12.

A drive 30 is coupled to the housing 12 and is positioned in the internal space 14. The drive 30 is operationally coupled to the rollers 18. The drive 30 is coupled to the rollers 18 such that the rollers 18 rotate coincidentally as a respective roller 18 is positioned and rolled upon a surface. In one embodiment, the drive 30 is configured such that the rollers 18 rotate in opposition.

The drive 30 comprises a pair of pulleys 32 and a belt 34. Each pulley 32 is rotationally coupled to the housing 12 and is axially coupled to a respective roller 18. In one embodiment, each pulley 32 is axially coupled to a respective axle 68. The belt 34 is positioned around and extends between the pulleys 32. In another embodiment, the belt 34 is twisted such that the rollers 18 rotate in opposition. In yet another embodiment, a bearing 36 is operationally coupled to a respective pulley 32 that is positioned proximate to the first end 16. The bearing 36 is one-way, such that the pulley 32 that is positioned proximate to the first end 16 rotates unidirectionally.

The device 10 comprises a strip 38 that has opposing ends 40. Each opposing end 40 is couplable to a respective roller 18. The strip 38 is variably rollably positionable around the rollers 18 as the rollers 18 rotate. An adhesive 42 is coupled to a face 44 of the strip 38. The strip 38 is positioned on the rollers 18 such that the face 44 is configured to contact the surface. The adhesive 42 is configured to adhesively collect debris onto the strip 38.

A handle 46 is coupled to and extends from the second end 22 of the housing 12. The handle 46 is positioned on the housing 12 such that the handle 46 is configured to grasp in a hand of a user, positioning a respective roller 18 to roll upon a surface to adhesively collect debris onto the strip 38. In one embodiment, the handle 46 extends substantially linearly from the housing 12

In another embodiment, the handle 46 comprises a first section 48 that extends linearly from the housing 12. A second section 50 is coupled to and extends substantially perpendicularly from the first section 48 distal from the housing 12. The second section 50 extends from the first section 48 such that an endpoint 52 of the second section 50 is substantially aligned with midpoints 54 of the rollers 18. A grasp 56 is coupled to and extends perpendicularly from the second section 50 proximate to the endpoint 52. The grasp 56 is positioned on the second section 50 such that the grasp 56 is configured to grasp in the hand of the user.

In one embodiment, the device 10 comprises an extension rod 58. A first coupler 60 is coupled to the handle 46 distal from the housing 12. A second coupler 62 is coupled to a terminus 64 of the extension rod 58. The second coupler 62 is complimentary to the first coupler 60. The second coupler 62 is positioned to couple to the first coupler 60 to couple the extension rod 58 to the handle 46. The extension rod 58 is configured to grasp in the hand of the user, positioning the rollers 18 to collect debris that is distal from the user. In another embodiment, the first coupler 60 comprises a socket 66 that is positioned longitudinally into the handle 46. The socket 66 is threaded.

In one embodiment, a guard 70 is coupled to the housing 12 adjacent to a respective roller 18 that is positioned proximate to the handle 46. The guard 70 is positioned on the housing 12 such that the guard 70 is configured to isolate soiled tape positioned on the respective roller 18 from the housing 12. In another embodiment, the guard 70 is substantially circularly shaped.

In use, the handle 46 is positioned on the housing 12 such that the handle 46 is configured to grasp in a hand of a user. The strip 38 is positioned on the rollers 18 such that the face 44 is configured to contact the surface. A respective roller 18 is configured to position and roll upon a surface to adhesively collect debris onto the strip 38. The drive 30 is coupled to the rollers 18 such that the rollers 18 rotate coincidentally as the respective roller 18 is rolled upon the surface. The strip 38 is variably rollably positionable around the rollers 18 as the rollers 18 rotate. The second coupler 62 is positioned to couple to the first coupler 60 to couple the extension rod 58 to the handle 46. The extension rod 58 is configured to grasp in the hand of the user to position the rollers 18 to collect debris that is distal from the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A debris collection device comprising:

a housing defining an internal space;

a pair of rollers, each said roller being rotationally coupled to and extending perpendicularly from a side of said housing, said rollers being positioned singly proximate to a first end and a second end of said housing;

a drive coupled to said housing and positioned in said internal space, said drive being operationally coupled to said rollers, said drive comprising a pair of pulleys, each said pulley being rotationally coupled to said housing and axially coupled to a respective said roller, and a belt positioned around and extending between said pulleys, said belt being twisted into a figure eight shape extending between and around said rollers such that said rollers rotate in opposition, said belt having a flat surface engaging each of said pulleys wherein said belt frictionally engages said pulleys, and a bearing operationally coupled to a respective said pulley positioned proximate to said first end, said bearing being one-way, such that said pulley positioned proximate to said first end rotates unidirectionally;

a strip having opposing ends, each said opposing end being couplable to a respective said roller;

an adhesive coupled to a face of said strip;

a handle coupled to and extending from said second end of said housing; and wherein said handle is positioned on said housing such that said handle is configured for grasping in a hand of a user, wherein said strip is positioned on said rollers such that said face is configured to contact the surface, wherein a respective said roller is configured for positioning and rolling upon the surface for adhesively collecting debris onto said strip, wherein said drive is coupled to said rollers such that said rollers rotate coincidentally as said respective said roller is rolled upon the surface.

2. The device of claim 1, further including said housing being substantially rectangularly box shaped.

3. The device of claim 1, further including said first end of said housing being rounded.

4. The device of claim 1, further including each said roller comprising:

a pair of endcaps;

a plurality of connectors coupled to and extending between said endcaps; and a tube reversibly positionable over said endcaps and said connectors, said tube being frictionally couplable to said connectors.

5. The device of claim 4, further including an axle coupled to and extending between said pair of endcaps, said axle extending through a respective said endcap into said housing.

6. The device of claim 1, further including said drive being configured such that said rollers rotate in opposition.

7. The device of claim 4, further including each said pulley being axially coupled to a respective said axle.

8. The device of claim 1, further including said handle extending substantially linearly from said housing.

9. The device of claim 1, further including said handle comprising:

a first section extending linearly from said housing;

a second section coupled to and extending substantially perpendicularly from said first section distal from said housing, said second section extending from said first section such that an endpoint of said second section is substantially aligned with midpoints of said rollers;

a grasp coupled to and extending perpendicularly from said second section proximate to said endpoint; and wherein said grasp is positioned on said second section such that said grasp is configured for grasping in the hand of the user.

10. The device of claim 9, further comprising:

a first coupler coupled to said handle distal from said housing;

an extension rod;

a second coupler coupled to a terminus of said extension rod, said second coupler being complimentary to said first coupler; and wherein said second coupler is positioned on said extension rod such that said second coupler is positioned to couple to said first coupler to couple said extension rod to said handle, such that said extension rod is configured for grasping in the hand of the user and wherein said rollers are positioned for collection of debris that is distal from the user.

11. The device of claim 10, further including said first coupler comprising a socket positioned longitudinally into said handle, said socket being threaded.

12. The device of claim 1, further including a guard coupled to said housing adjacent to said respective said roller positioned proximate to said handle, wherein said guard is positioned on said housing such that said guard is configured for isolating soiled tape positioned on said respective said roller from said housing.

13. The device of claim 11, further including said guard being substantially circularly shaped.

14. A debris collection device comprising:

a housing defining an internal space, said housing being substantially rectangularly box shaped, said housing having a first end, said first end being rounded;

a pair of rollers, each said roller being rotationally coupled to and extending perpendicularly from a side of said housing, said rollers being positioned singly proximate to said first end and a second end of said housing, each said roller comprising:

a pair of endcaps, a plurality of connectors coupled to and extending between said endcaps, and a tube reversibly positionable over said endcaps and said connectors, said tube being frictionally couplable to said connectors;

a drive coupled to said housing and positioned in said internal space, said drive being operationally coupled to said rollers, wherein said drive is coupled to said rollers such that said rollers rotate coincidentally as a respective said roller is positioned and rolled upon a surface, said drive being configured such that said rollers rotate in opposition, said drive comprising:

a pair of pulleys, each said pulley being rotationally coupled to said housing and axially coupled to a respective said roller, a belt positioned around and extending between said pulleys, said belt being twisted into a figure eight shape extending between and around said pulleys such that said rollers rotate in opposition, said belt having a flat surface engaging each of said pulleys wherein said belt frictionally engages said pulleys, and a bearing operationally coupled to a respective said pulley positioned proximate to said first end, said bearing being one-way, such that said pulley positioned proximate to said first end rotates unidirectionally;

a strip having opposing ends, each said opposing end being couplable to a respective said roller, wherein said strip is variably rollably positionable around said rollers as said rollers rotate;

an adhesive coupled to a face of said strip, wherein said strip is positioned on said rollers such that said face is configured to contact the surface, such that said adhesive is configured for adhesively collecting debris onto said strip;

a handle coupled to and extending from said second end of said housing, wherein said handle is positioned on said housing such that said handle is configured for grasping in a hand of a user, wherein a respective said roller is configured for positioning and rolling upon a surface for adhesively collecting debris onto said strip, said handle extending substantially linearly from said housing, said handle comprising:

a first section extending linearly from said housing, a second section coupled to and extending substantially perpendicularly from said first section distal from said housing, said second section extending from said first section such that an endpoint of said second section is substantially aligned with midpoints of said rollers, a grasp coupled to and extending perpendicularly from said second section proximate to said endpoint, and wherein said grasp is positioned on said second section such that said grasp is configured for grasping in the hand of the user;

a first coupler coupled to said handle distal from said housing, said first coupler comprising a socket positioned longitudinally into said handle, said socket being threaded;

an extension rod;

a second coupler coupled to a terminus of said extension rod, said second coupler being complimentary to said first coupler, wherein said second coupler is positioned on said extension rod such that said second coupler is positioned to couple to said first coupler to couple said extension rod to said handle, such that said extension rod is configured for grasping in the hand of the user and wherein said rollers are positioned for collection of debris that is distal from the user;

a guard coupled to said housing adjacent to said respective said roller positioned proximate to said handle, wherein said guard is positioned on said housing such that said guard is configured for isolating soiled tape positioned on said respective said roller from said housing, said guard being substantially circularly shaped; and wherein said handle is positioned on said housing such that said handle is configured for grasping in a hand of a user, wherein said strip is positioned on said rollers such that said face is configured to contact a surface, wherein a respective said roller is configured for positioning and rolling upon the surface for adhesively collecting debris onto said strip, wherein said drive is coupled to said rollers such that said rollers rotate coincidentally as said respective said roller is rolled upon the surface, such that said strip is variably rollably positionable around said rollers as said rollers rotate, and wherein said second coupler is positioned on said extension rod such that said second coupler is positioned to couple to said first coupler to couple said extension rod to said handle, such that said extension rod is configured for grasping in the hand of the user and wherein said rollers are positioned for collection of debris that is distal from the user.

* * * * *